US008454373B2

(12) United States Patent
Cheng et al.

(10) Patent No.: US 8,454,373 B2
(45) Date of Patent: Jun. 4, 2013

(54) SOCKET WITH LOWER CONTACTS WITH CONFIGURATION

(75) Inventors: Chih-Pi Cheng, New Taipei (TW); Jia-Hau Liu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 27 days.

(21) Appl. No.: 13/181,722

(22) Filed: Jul. 13, 2011

(65) Prior Publication Data

US 2012/0015559 A1 Jan. 19, 2012

(30) Foreign Application Priority Data

Jul. 13, 2010 (TW) ..... 99213304

(51) Int. Cl.
*H01R 12/00* (2006.01)

(52) U.S. Cl.
USPC ..... 439/66; 439/862

(58) Field of Classification Search
USPC ..... 439/66, 83, 733.1, 862
See application file for complete search history.

(56) References Cited

U.S. PATENT DOCUMENTS

| | | | | |
|---|---|---|---|---|
| 4,813,881 | A * | 3/1989 | Kirby | 439/74 |
| 6,877,998 | B1 * | 4/2005 | Kim et al. | 439/108 |
| 6,887,114 | B2 * | 5/2005 | Liao | 439/862 |
| 6,955,572 | B1 | 10/2005 | Howell | |
| 7,429,200 | B2 * | 9/2008 | Lee et al. | 439/862 |
| 7,445,464 | B2 * | 11/2008 | Ma et al. | 439/71 |
| 7,578,675 | B2 * | 8/2009 | Polnyl et al. | 439/66 |
| 7,632,105 | B2 * | 12/2009 | Yan | 439/66 |
| 7,857,632 | B2 * | 12/2010 | Liu et al. | 439/66 |

FOREIGN PATENT DOCUMENTS

CN 201112757 9/2008

* cited by examiner

*Primary Examiner* — Thanh Tam Le
(74) *Attorney, Agent, or Firm* — Wei Te Chung; Ming Chieh Chang

(57) ABSTRACT

A socket for receiving an IC (integrate circuit) package comprises an insulative housing and a plurality of contacts. The insulative housing defines a plurality of contact passageways for receiving the contacts. Each contact has a retaining portion, an elastic arm and a soldering portion, and the retaining portion is formed with a first part, a second part and a bending part between the first and the second parts. Each of the first and the second parts is formed with a protrusion on an outside lateral edge thereof away from the bending part for interfering with the contact passageway of the insulative housing to retain the contact to the insulative housing.

10 Claims, 5 Drawing Sheets

SOCKET WITH LOWER CONTACTS WITH CONFIGURATION

BACKGROUND OF THE INVENTION

1. Field of the Invention

The present invention relates to a socket for connecting an IC (integrated Circuit) package and a printed circuit board, and more particularly, to a socket having contacts with lower configuration.

2. Description of the Related Art

To electrically connect to a printed circuit board, an IC (integrated Circuit) package usually need a socket to electrically connecting the IC package to the printed circuit board, for transferring signals between the IC package and the printed circuit board. U.S. Pat. No. 6,955,572 discloses a related socket, which has an insulative housing and a plurality of contacts received in the insulative housing. The contact has a main body, an elastic contacting arm bent from a lateral side of the main body and a linking portion aslant extending upwardly from the main body for connecting with contact trips, a retaining portion extending downwardly from the main body and a soldering portion extending downwardly from the retaining portion. The elastic contacting arm is formed with a contacting portion for contacting with the IC package at a free end thereof. The retaining portion is formed with a plurality of barbs interfering with inner walls of a contact passageway defined on the insulative housing to retain the contact.

Lately developing trend of the IC package and the socket is to be miniaturized and low structured, so the contact is required not only to have enough elasticity but also to have a lower configuration. The contact disclosed in said U.S. Pat. No. 6,955,572 has the elastic contacting arm, the main body, the retaining portion and the soldering portion in turn along a height direction of thereof, that causes the contact has a large total height. Furthermore, the barbs are disposed on two opposite sides of the main body, so the retaining forces are located in one beeline, the contact may rock in the contact passageway when be pressed by the IC package, and that will influent the connection between the IC package and the contact.

Hence, it is required to improve the disadvantages of the above socket.

SUMMARY OF THE INVENTION

An object of the invention is to provide a socket having contacts with a lower configuration.

To achieve the above-mentioned object, a socket for receiving an IC (integrate circuit) package, comprises an insulative housing and a plurality of contacts stamped from metal piece. The insulative housing defines a plurality of contact passageways extending though a top and a bottom surfaces thereof, and the contacts are received in the contact passageways. Each contact has a retaining portion, an elastic arm and a soldering portion, the retaining portion is formed with a first part, a second part and a bending part between the first and the second parts, and each of the first and the second parts is formed with a protrusion on an outside lateral edge thereof away from the bending part. The protrusions interfere with the contact passageway of the insulative housing to retain the contact to the insulative housing.

Other features and advantages of the present invention will become more apparent to those skilled in the art upon examination of the following drawings and detailed description of preferred embodiments, in which:

DETAILED DESCRIPTION OF PREFERRED EMBODIMENT

Reference will now be made in detail to the preferred embodiments of the present invention.

Figure 1:
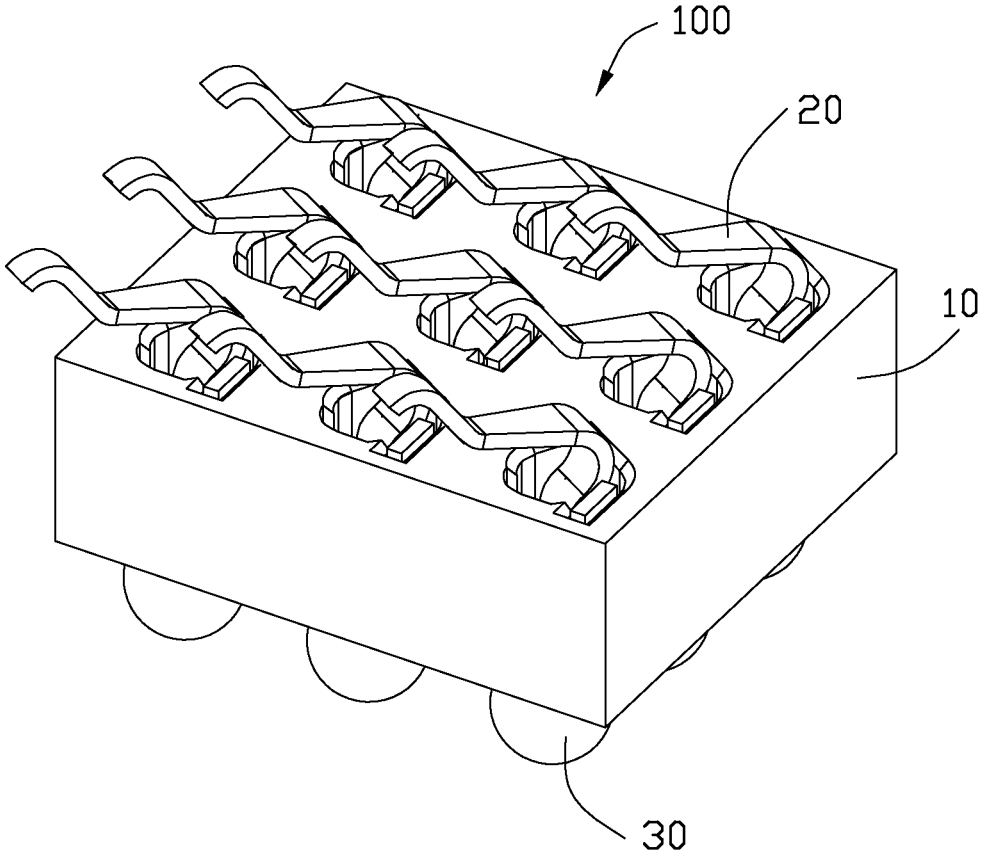
FIG. 1 is an assembled, perspective view of a part of a socket in accordance with present invention.
Figure 2:
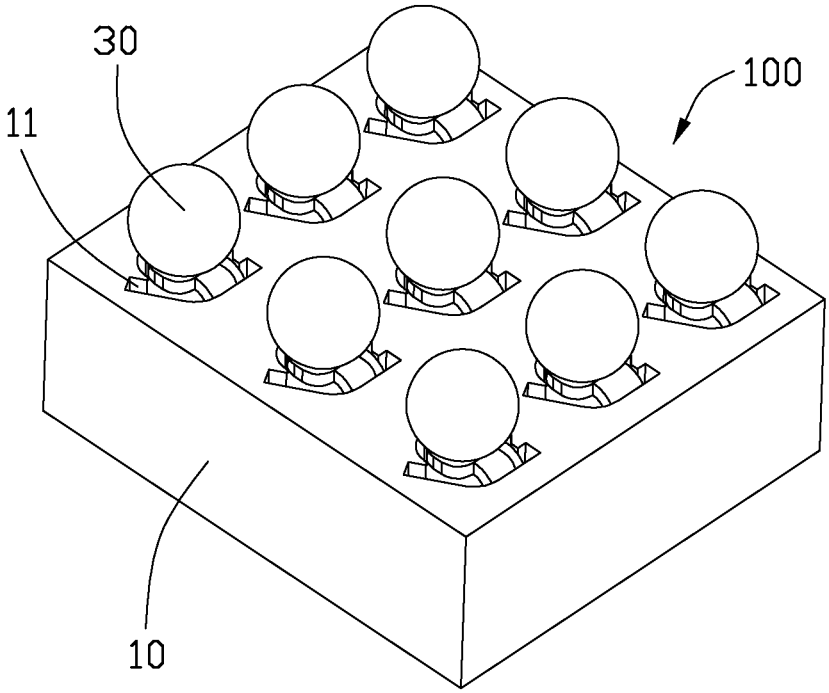
FIG. 2 is similar with FIG. 1, but taken from another side.

Referring to FIG. 1 and FIG. 2, a socket 100 in accordance to an embodiment of present invention is mounted on a printed circuit board (not shown) for electrically connecting an IC (integrated Circuit) package. The socket 100 comprises an insulative housing 10 and a plurality of contacts 20. The insulative housing 10 is formed by plastic material and has a plurality of contact passageways 11 passing through a top and a bottom surface thereof, the contacts 20 are received in the contact passageways 11.

Figure 3:
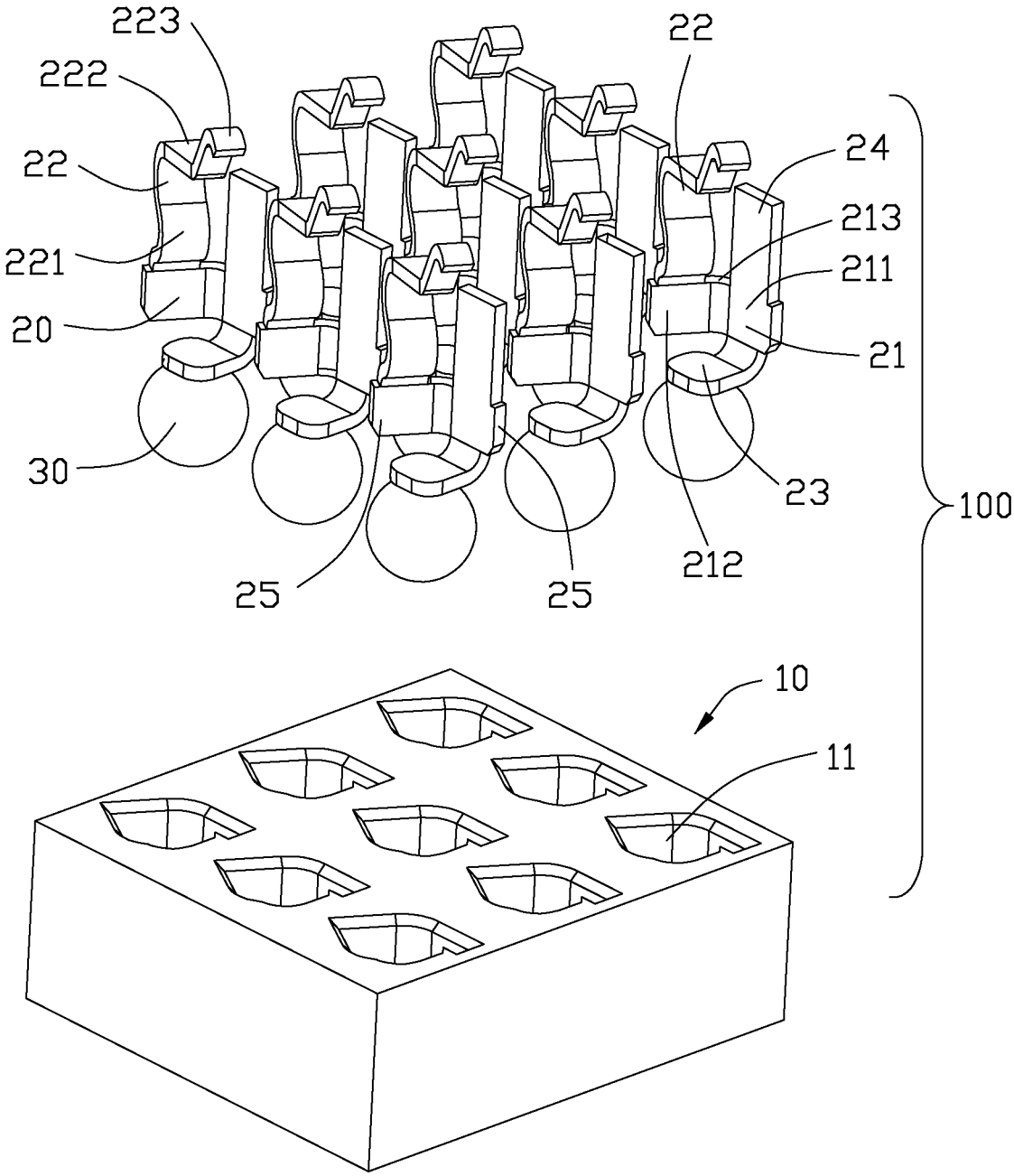
FIG. 3 is a partially assembled, perspective view of the part of the socket.

Referring to FIG. 3, the contact 20 is stamped from a metal piece, each contact 20 has a retaining portion 21, an elastic arm 22, a soldering portion 23 and a connecting portion 24. The retaining portion 21 has a first part 211 and a second part 212 bent from a lateral side of the first part 211 and defining an angle together with the second part 212. A bending part 213 is formed between the first part 211 and the second part 212, so that the retaining portion 21 has a substantially arch shape. Each of the first part 211 and the second part 212 has a top edge, a bottom edge and an outside lateral edge without connecting with the bending part 213. Each outside lateral edge has a protrusion 25, which interferes with an inner sidewall of the contact passageway 11 to retain the contact 20 to the insulative housing 10.

The elastic arm 22 extends upwardly from the top edge of the second part 212 of the retaining portion 21. The elastic arm 22 has a substantial wave-shaped elastic connecting arm 221 connecting with the retaining portion 21, a deflective extending arm 222 aslant extending from the elastic connecting arm 221 and a contacting portion 223 at a free end of the extending arm 222. The soldering portion 23 is bent from the bottom edge of the first part 211 of the retaining portion 21. A solder ball 30 is disposed on the soldering portion 23 to electrically connect the contact 20 to the printed circuit board (not shown). The connecting portion 24 extends upwardly from the top edge of the first part 211 for connecting with the contact trip (not shown).

Figure 4:
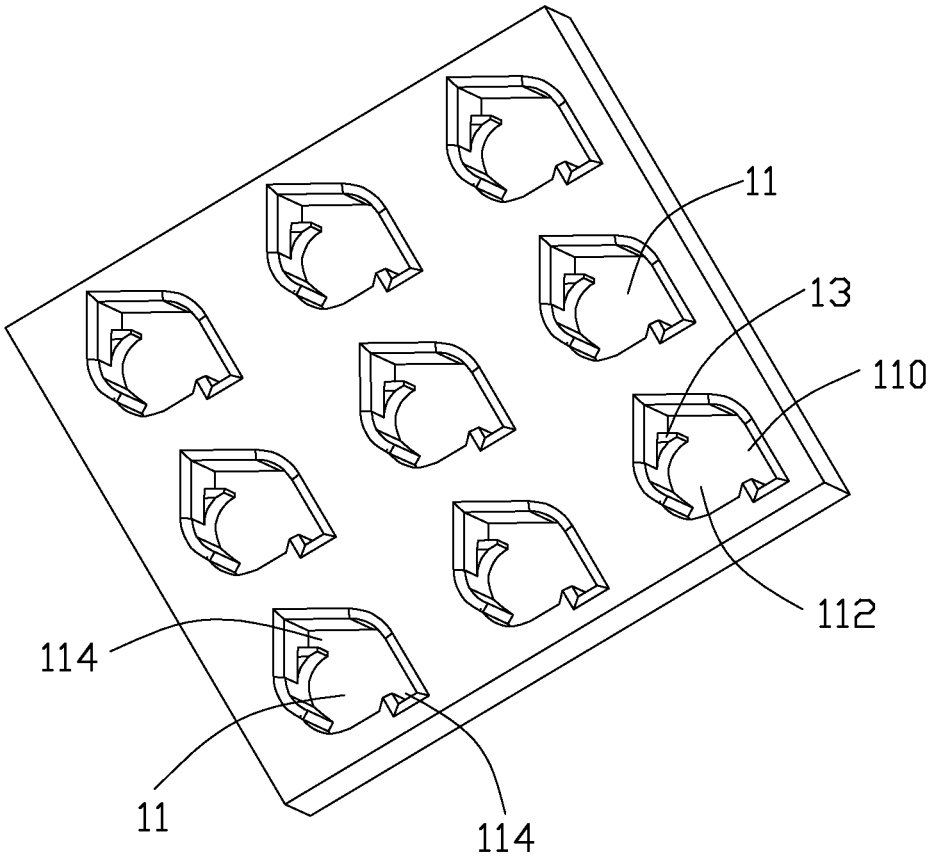
FIG. 4 is a perspective view of an insulative housing of the part of the socket shown in FIG. 3.
Figure 5:
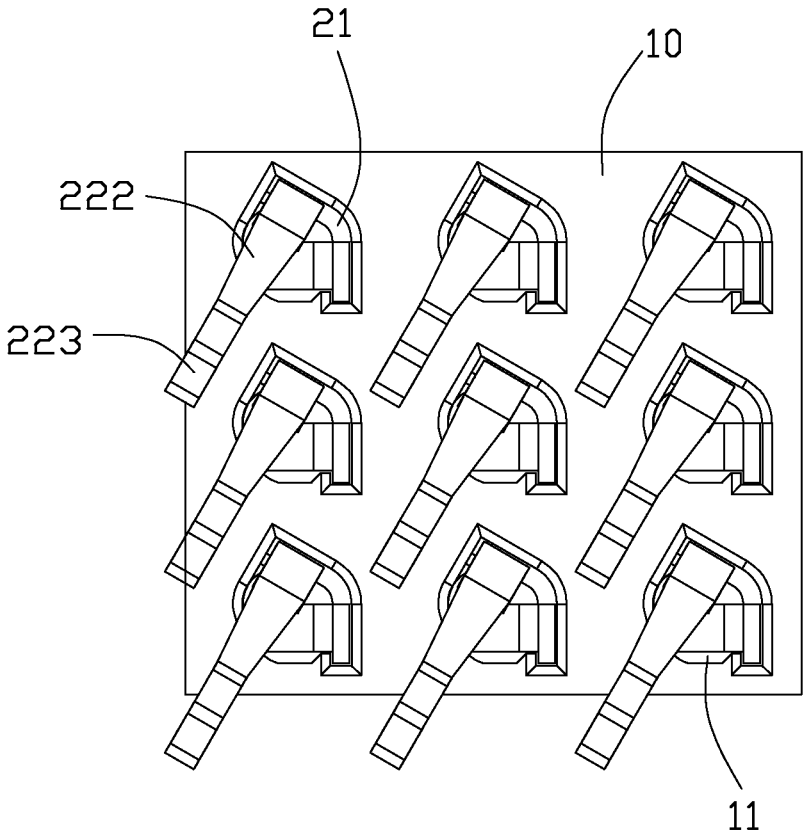
FIG. 5 is a top view of the part of the socket shown in FIG. 1.

Referring to FIG. 4 and FIG. 5, the insulative housing 10 is formed with a clump 13 within the contact passageway 11, the clump 13 is located on the bottom of the contact passageway 11. The contact passageway 11 has a retaining slot 110 and a receiving slot 112, wherein the retaining slot 110 receives the retaining portion 21 and has two parts and a corner connecting the two parts to be corresponding to the configuration of the retaining portion 21 of the contact 20. The retaining slot 110 defines two narrow slots 114 on two ends thereof to limit the retaining portion 21 of the contact 20 to prevent the contact 20 from swinging. One of the narrow slots 114 is defined by the clump 13 and two inner walls of the retaining slot 110. The receiving slot 112 receives the elastic connecting arm 221 and has a fan-shaped area.

When assembly, the contact 20 is disposed into the contact passageway 11 from top to bottom, the contact 20 is retained to the contact passageway 11 by the protrusion 25 interfering with the contact passageway 11, the deflective extending arm 222 extends beyond the contact passageway 11 for contacting with the IC package (not shown). The solder ball 30 attached to the soldering portion 23 is exposed on a bottom surface of the insulative housing 10.

Compared to prior contacts in prior connector, the socket 100 of present invention makes a traditional part in this type contact of similar socket, which usually connects the connecting portion 24 and the elastic arm 22, also be a retaining part, no additional retaining means is needed between the elastic arm 22 and the soldering portion 23, so that a height of the contact 20 can be obviously reduced. Furthermore, the retaining portion 21 of the contact 20 has the first part 211 and the second part 212, which define an angle therebetween, and the contact passageway 11 has a corresponding configuration. So the interference forces between the retaining portion 21 of the contact 20 and the insulative housing 10 extend along two different and unparallel directions that can prevent the contact 20 from rocking and ensure the contact 20 is precisely positioned.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A socket for receiving an IC (integrate circuit) package, comprising:

an insulative housing defining a plurality of contact passageways extending though a top and a bottom surfaces thereof; and a plurality of contacts stamped from metal piece and received in the contact passageways, each contact having a retaining portion, an elastic arm and a soldering portion, the retaining portion formed with a first part, a second part and a bent part between the first and the second parts, and each of the first and the second parts formed with a protrusion on an outside lateral edge thereof away from the bent part, the protrusions interfering with the contact passageway of the insulative housing to retain the contact to the insulative housing;

wherein the first part and the second part define an angle therebetween;

wherein the interfering forces between the protrusions of the first part and the second part and the insulative housing extend along two different and unparallel directions;

wherein the contact passageway has a retaining slot receiving the retaining portion and a receiving slot receiving the elastic arm, the retaining slot has two parts and a comer connecting the two parts to be corresponding to the configuration of the retaining portion of the contact; and wherein the retaining slot defines two narrow slots on two ends thereof, one of the narrow slots is defined by inner walls of the retaining slot and a clump formed in the contact passageway.

2. The socket as described in claim 1, wherein each of the first part and the second part has a top edge, a bottom edge and the outside lateral edge, the elastic arm extends upwardly from the top edge of the second part, the soldering portion is bent from the bottom edge of the first part.

3. The socket as described in claim 2, wherein the elastic arm has a substantial wave-shaped elastic connecting arm connecting with the retaining portion, a deflective extending arm aslant extending from the elastic connecting arm and a contacting portion at a free end of the extending arm.

4. The socket as described in claim 3, wherein the contact has a connecting portion extending upwardly from the top edge of the first part of the retaining portion for connecting with a contact trip.

5. A socket comprising:

an insulative housing defining a plurality of passageways extending therethrough in a vertical direction, each of said passageways defining first and second interior upstanding surfaces essentially angled with each other while with a joint therebetween, a first retaining slot formed around an outer edge of the first interior upstanding surface laterally opposite to the joint and a second retaining slot formed around an outer edge of the second interior upstanding surface laterally opposite to the joint; and a plurality of contacts disposed in the corresponding passageways, respectively, each of said contacts defining a retaining portion including a first part and a second part joined with each other at an angle and respectively abutting against the corresponding first interior upstanding surface and second interior upstanding surface, a solder pad extending from the first part for coupling to a corresponding solder ball, and a resilient contacting section upwardly extending from the second part for engagement with an electronic package; wherein a lateral outer edge of the first part is retained in the corresponding first retaining slot, and a lateral outer edge of the second part is retained in the corresponding second retaining slot, whereby the contact is retained to the corresponding passageway wherein in each of the passageways, the housing defines a protrusion to cooperate with the first interior upstanding surface to form the corresponding first retaining slot, and further defines a clump to cooperate with the second interior upstanding surface to form the corresponding second retaining slot; and wherein the lateral outer edge of said first part is equipped with a protrusion interfering within the first retaining slot; the lateral outer edge of said second part is equipped with a protrusion interfering within the second retaining slot.

6. The socket connector as claimed in claim 5, wherein the first interior upstanding surface and the second interior upstanding surface commonly form an obtuse angle therebetween.

7. The socket connector as claimed in claim 6, wherein in each of the contacts, the first part and the second part are joined with each other via a curved bent part therebetween.

8. The socket connector as claimed in claim 7, wherein the joint between the corresponding first interior upstanding surface and second interior upstanding surface is curved.

9. The socket connector as claimed in claim 5, wherein the clump defines a height smaller than that of the passageway for not interfering with the contacting section of the corresponding contact.

10. The socket connector as claimed in claim 5, wherein each of the contact further includes a connecting portion upwardly extending from the first part and abutting against the first interior upstanding surface with an edge retained in the corresponding first retaining slot for stabilizing the contact in the corresponding passageway.

* * * * *